US009032749B2

(12) United States Patent
Korenaga et al.

(10) Patent No.: US 9,032,749 B2
(45) Date of Patent: May 19, 2015

(54) INDOOR EXPANSION VALVE INITIALIZATION SEQUENCE FOR AN AIR CONDITIONER

(75) Inventors: Kazunori Korenaga, Tokyo (JP); Takeshi Kuramochi, Tokyo (JP); Yoshio Yajima, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 346 days.

(21) Appl. No.: 13/050,132

(22) Filed: Mar. 17, 2011

(65) Prior Publication Data

US 2011/0232311 A1 Sep. 29, 2011

(30) Foreign Application Priority Data

Mar. 23, 2010 (JP) ..... 2010-66104

(51) Int. Cl.
*F25B 41/04* (2006.01)
*F24F 3/06* (2006.01)
(Continued)

(52) U.S. Cl.
CPC ..... *F24F 3/065* (2013.01); *F25B 49/022* (2013.01); *F24F 11/06* (2013.01); *F24F 2011/0045* (2013.01); *F24F 2011/0082* (2013.01); *F24F 2011/0083* (2013.01); *F25B 13/00* (2013.01); *F25B 2313/0233* (2013.01); *F25B 2313/02741* (2013.01); *F25B 2341/0661* (2013.01); *F25B 2500/26* (2013.01); *F25B 2600/2513* (2013.01); *F25B 2700/21152* (2013.01)

(58) Field of Classification Search
CPC ..... F25B 2313/023; F25B 2313/0231; F25B 2600/2513; F25B 2600/0253; F25B 2313/02331; F25B 5/02; F25B 2700/101; F25B 2700/197; F25B 2313/0233; F25B 2500/26; F25B 49/022
USPC ..... 62/208, 222, 199, 200
See application file for complete search history.

(56) References Cited

U.S. PATENT DOCUMENTS 4,644,756 A * 2/1987 Sugimoto et al. ..... 62/160
4,766,735 A * 8/1988 Gotou ..... 62/175
(Continued)

FOREIGN PATENT DOCUMENTS

JP 60-185076 A 9/1985
JP 63-204079 A 8/1988
(Continued)

OTHER PUBLICATIONS

Machine translation of KR1020010048759.*
(Continued)

*Primary Examiner* — Marc Norman
*Assistant Examiner* — Max Snow
(74) *Attorney, Agent, or Firm* — Buchanan Ingersoll & Rooney PC

(57) ABSTRACT

This invention relates to a multi-room air conditioning system with a plurality of indoor expansion valves. A method for sequencing the initialization of each indoor expansion valve upon system startup is disclosed. The method includes the following steps:

1. Initializing expansion valves corresponding to active indoor units,
2. Turning on the compressor,
3. Adjusting the indoor expansion valves corresponding to active indoor units,
4. Initializing and adjusting indoor expansion valves corresponding to inactive indoor units.

3 Claims, 6 Drawing Sheets

(51) Int. Cl.

| | |
|---|---|
| ***F24F 11/06*** | (2006.01) |
| ***F25B 13/00*** | (2006.01) |
| *F25B 49/02* | (2006.01) |
| *F24F 11/00* | (2006.01) |

(56) References Cited

U.S. PATENT DOCUMENTS

| | | | | |
|---|---|---|---|---|
| 4,932,220 | A * | 6/1990 | Inoue | 62/175 |
| 5,263,333 | A * | 11/1993 | Kubo et al. | 62/160 |
| 5,669,231 | A * | 9/1997 | Itoh et al. | 62/210 |
| 6,453,690 | B1 * | 9/2002 | Kim | 62/222 |
| 6,843,067 | B2 * | 1/2005 | Lee et al. | 62/175 |
| 7,380,407 | B2 * | 6/2008 | Jung et al. | 62/200 |
| 7,600,389 | B2 * | 10/2009 | Kim et al. | 62/200 |
| 7,793,511 | B2 * | 9/2010 | Yoon et al. | 62/208 |
| 8,151,583 | B2 * | 4/2012 | Douglas | 62/222 |
| 8,522,568 | B2 * | 9/2013 | Okamoto et al. | 62/200 |
| 2005/0155361 | A1 * | 7/2005 | Jung et al. | 62/159 |
| 2007/0113568 | A1 * | 5/2007 | Jang et al. | 62/222 |
| 2008/0028779 | A1 * | 2/2008 | Song | 62/190 |
| 2008/0216500 | A1 * | 9/2008 | Chen et al. | 62/225 |
| 2010/0174412 | A1 * | 7/2010 | Kwon et al. | 700/275 |
| 2010/0198416 | A1 * | 8/2010 | Kasahara et al. | 700/282 |

FOREIGN PATENT DOCUMENTS

| | | | | |
|---|---|---|---|---|
| JP | 5-52429 | A | 3/1993 | |
| JP | 6-257826 | A | 9/1994 | |
| KR | 1020010048759 | * | 6/2001 | F24F 11/02 |

OTHER PUBLICATIONS

Machine Translation of JP H06 257826 Sep. 1994.*

Office Action (Notice of Reasons for Rejection) issued May 7, 2013, in the corresponding Japanese Patent Application No. 2010-066104 with an English translation. (4 pages).

Office Action (Patent Examination Report No. 1) dated Jul. 4, 2012, in the corresponding Australian Patent Application No. 2011200955. (4 pages).

Chinese Office Action dated Feb. 27, 2013, issued in corresponding Chinese Patent Application No. 2011100686949 and English translation. (6 pages).

European Search Report dated Feb. 12, 2015 issued in corresponding European Patent Appln. No. 11002155.7 (6 pages).

* cited by examiner

INDOOR EXPANSION VALVE INITIALIZATION SEQUENCE FOR AN AIR CONDITIONER

BACKGROUND OF THE INVENTION

1. Field of the Invention

The present invention relates to multi-room air conditioning apparatuses and, more particularly, relates to an initialization procedure for an electronic expansion valve that serves as a decompression device for the multi-room air conditioning apparatuses.

2. Description of the Related Art

A refrigerant circuit configuration of a typical multi-room air conditioning apparatus includes a plurality of indoor units and an outdoor unit having a compressor, an outdoor heat exchanger, and a four-way valve for switching a refrigerant flow direction. Also, each indoor unit has an electronic expansion valve for decompressing a condensed refrigerant. The electronic expansion valve is disposed in the outdoor unit, the indoor unit, or a branch box. The compressor, the four-way valve, and the electronic expansion valve are connected to and controlled by a control device, depending on various operating conditions.

In response to an operation command issued by any of the indoor units in the rooms all of which are in a shutdown state, the compressor starts up and delivers a refrigerant, which goes through the four-way valve to the outdoor heat exchanger where, in a cooling mode, the refrigerant is condensed. Then, the refrigerant is decompressed through an electronic expansion valve and is subjected to heat exchange using evaporation action in the indoor unit, and is finally returned to the compressor. In a heating mode, a refrigerant flow is turned by the four-way valve to the opposite direction of that in the cooling mode. Then the refrigerant is condensed at the indoor unit, is decompressed through the electronic expansion valve, and then goes to the outdoor unit where the refrigerant is subjected to heat exchange using evaporation action in the outdoor heat exchanger and is finally returned to the compressor.

The electronic expansion valve can adjust the decompression degree and the amount of refrigerant circulation by changing the valve opening degree. The electronic expansion valve corresponding to the indoor unit which has issued the operation command is controlled with regard to the valve opening degree by monitoring the rotational speed of the compressor, discharge temperatures, the degree of supercooling, and the like so as to provide a proper refrigerating cycle. Other electronic expansion valves corresponding to indoor units which have issued no operation command are also controlled not to full close but to slight opening degree so as to prevent valve sticking or refrigerant pooling.

As described above, in order to provide valve opening degree control for the electronic expansion valve, the opening degrees of all of the electronic expansion valves are all closed so as to adjust the zero (starting) point before the refrigeration cycle is activated. This operation is referred to the initialization of the electronic expansion valve.

A specific initialization control operation is described below. Assuming that the electronic expansion valve that has not yet been initialized had a full open opening degree A, the control device issues a command for closing the electronic expansion valve by the amount of −A or more. This operation inevitably results in adjusting zero point, regardless of any opening degree before the initialization. This operation takes a few seconds for each electronic expansion valve.

When the initialization of the electronic expansion valves does not complete, the procedure for activating the refrigerating cycle is as follows: First, all of the electronic expansion valves are initialized. Then, immediately after activation of the compressor following the completion of the expansion valve initialization, the electronic expansion valves is operated and set to a predetermined opening degree.

However, the more the number of the indoor units to be connected to the entire system increase, the more the number of the corresponding electronic expansion valves increase. As described above, the completion of the initialization of all the electronic expansion valves followed by the activation of the compressor results in a significant loss of time from the issuance of an operation command until the activation of the refrigerating cycle.

The relationship between the refrigerating cycle operation and the electronic expansion valve initialization of conventional multi-room air conditioning apparatuses is disclosed in Patent Literature 1 and Patent Literature 2.

Patent Literature 1 discloses a multi-room air conditioning apparatus employing an electronic expansion valve that allows a certain amount of a refrigerant to flow even at the fully closed opening degree for the purpose of fully closing the electronic expansion valves for initialization without suspending the compressor during the system operation.

Patent Literature 2 discloses a multi-room air conditioning apparatus in which a plurality of electronic expansion valves are arranged so as to correspond to one indoor unit, one of which is initialized in advance to provide a predetermined opening after the initialization and subsequently the remaining electronic expansion valves are preformed the same operation in order, for the purpose of fully closing the electronic expansion valves for initialization without suspending the compressor during the system operation.

CITATION LIST

Patent Literature

[Patent Literature 1] Japanese Unexamined Patent Application Publication No. 63-204079

[Patent Literature 2] Japanese Unexamined Patent Application Publication No. 5-52429

However, these publications disclose a procedure for initializing the electronic expansion valves without suspending the compressor during the system operation, but do not disclose electronic expansion valves initialization procedure to be performed before the system operation, namely, before the activation of the compressor.

SUMMARY OF INVENTION

Technical Problem

To initiate the refrigerating cycle when the electronic expansion valves have not yet been initialized, first, all of the electronic expansion valves are initialized. Then, immediately after activation of the compressor following the completion of the expansion valve initialization, each electronic expansion valve proceeds to a step of adjusting to a predetermined opening degree.

However, the multi-room air conditioning apparatus has recently showed a tendency toward further increasing number of indoor units. The increasing number of indoor units causes the corresponding electronic expansion valves to also increase in number. Since it takes several seconds to initialize one electronic expansion valve, one-by-one initialization of all the electronic expansion valves requires several tens of seconds to several minutes if a great number of indoor units are provided. This initialization followed by the activation of the compressor will lead to a significant loss of time from the issuance of an operation command until the activation of the refrigerating cycle, giving inconvenience to users who want sooner start-up of cooling/heating capabilities.

To solve this problem, simultaneous initialization of more than one electronic expansion valve is conceivable, but it will result in the necessity for more complicated electronic expansion valve control devices, leading to increased costs.

The present invention has been achieved in light of the foregoing and an object thereof is to provide a multi-room air conditioning apparatus which, without using a complicated control device for simultaneously controlling the opening degree of a plurality of electronic expansion valves, reduces a waiting time associated with the initialization of the electronic expansion valves to be performed before the activation of the compressor, thereby reducing a loss of time until the activation of a refrigerating cycle and giving no inconvenience to users.

Solution to Problem

A multi-room air conditioning apparatus according to a first aspect of the present invention includes a plurality of indoor units, a compressor, an outdoor heat exchanger, a four-way valve, a plurality of electronic expansion valves corresponding to the plurality of indoor units, respectively, and a control device for controlling the compressor, the outdoor heat exchanger, the four-way valve, the plurality of indoor units, and the plurality of electronic expansion valves, wherein the control device performs the following processing steps of activating a refrigerating cycle when the opening degree of the electronic expansion valves has not yet been initialized:

(a) Each opening degree of only electronic expansion valves corresponding to all of the indoor units which have issued an operation command is initialized; (b) after the initialization is completed for all of the electronic expansion valves corresponding to all of the indoor units which have issued an operation command, the compressor is activated; (c) every opening degree of the electronic expansion valves whose initialization has been completed is adjusted to a predetermined operational opening degree; (d) the opening degree of electronic expansion valves corresponding to indoor units which have issued no operation command is initialized and is adjusted to a predetermined opening degree.

A multi-room air conditioning apparatus according to a second aspect of the present invention includes a sensor for sensing a compressor discharge temperature, wherein, if the discharge temperature abnormally rises when the opening degree of electronic expansion valves corresponding to indoor units which have issued no operation command is being initialized, the control device has a function to suspend closing of such electronic expansion valves for a certain period of time and to maintain the current opening degree for a certain period of time.

A first aspect of the present invention has the effect of reducing a waiting time associated with the initialization of the electronic expansion valves to be performed before the activation of the compressor of a multi-room air conditioning apparatus without using a complicated control device for simultaneously controlling the opening degree of the plurality of electronic expansion valves, thereby reducing a loss of time until the activation of the refrigerating cycle and giving no inconvenience to users.

A second aspect of the present invention has the effect of preventing an ejection of a compressor oil from the compressor due to a rapid temperature rise of the refrigerant that is envisioned at the time of the initialization of the electronic expansion valves corresponding to indoor units which have issued no operation command in the first aspect, thereby avoiding a risk of damage to the compressor.

DESCRIPTION OF THE PREFERRED EMBODIMENTS

Four refrigerant circuit configurations applicable to a multi-room air conditioning apparatus according to the present invention are shown in FIGS. 1 to 4.

Embodiment 1

Figure 1:
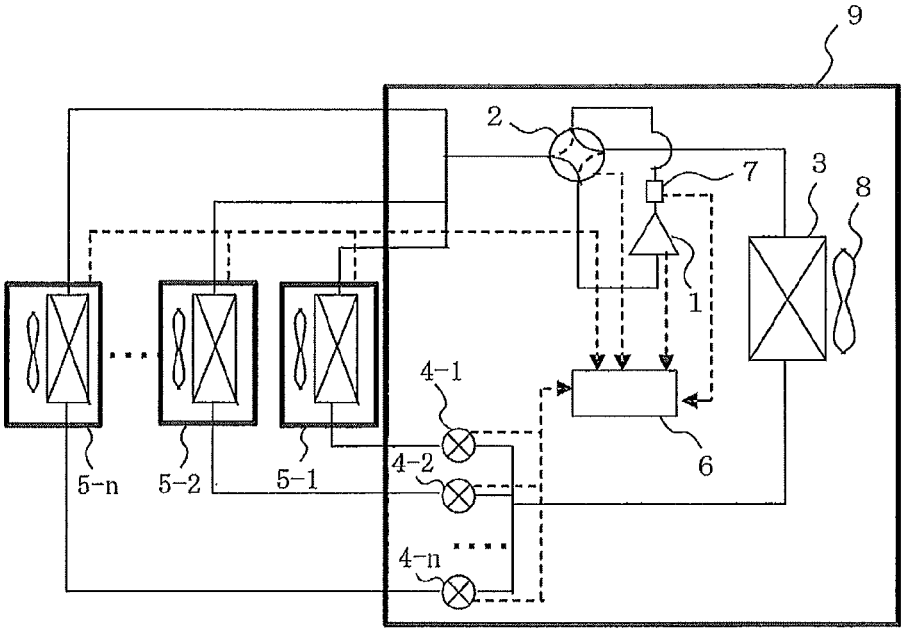
FIG. 1 is a refrigerant circuit configuration of a multi-room air conditioning apparatus according to Embodiment 1 of the present invention.

FIG. 1 is a refrigerant circuit configuration of a multi-room air conditioning apparatus according to Embodiment 1 of the present invention. A multi-room air conditioning apparatus according to Embodiment 1 includes one outdoor unit 9 and a plurality of indoor units 5-1 to **5-*n*, each having an indoor heat exchanger and a blower fan, wherein the plurality of indoor units 5-1 to 5-*n* are connected in parallel to the outdoor unit 9 using refrigerant tubes to form a refrigerant circuit. The outdoor unit 9 is provided therein with a compressor 1, a four-way valve 2 for switching a direction in which a refrigerant flows, an outdoor heat exchanger 3, a blower fan 8, and electronic expansion valves 4-1 to 4-*n* that are arranged so as to correspond to the indoor units 5-1 to 5-*n*, respectively, and decompress a condensed refrigerant. The compressor 1, the four-way valve 2, and the electronic expansion valves 4-1 to 4-*n* are controlled by a control device (outdoor unit control device) 6. The control device 6 is capable of receiving various pieces of indoor unit operation information such as an operation command issued by the indoor units 5-1 to 5-*n***.

In addition, the outdoor unit 9 is provided on the upper portion of the compressor shell or on the discharge tubes with a discharge temperature sensor 7 for sensing the temperature of a refrigerant discharged through the compressor. The control device 6 can receive temperature information provided by the discharge temperature sensor 7.

Embodiment 2

Figure 2:
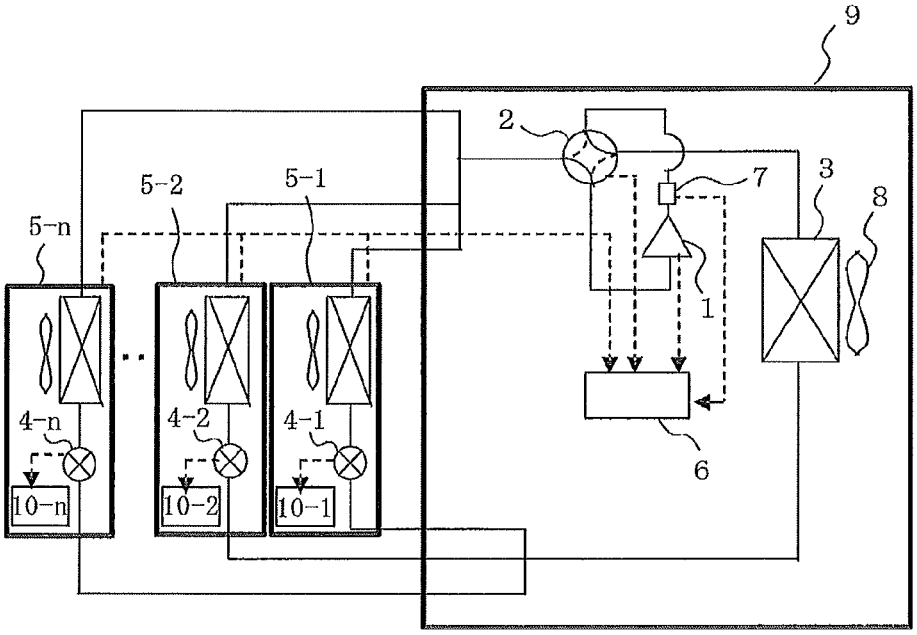
FIG. 2 is a refrigerant circuit configuration of a multi-room air conditioning apparatus according to Embodiment 2 of the present invention.

FIG. 2 is a refrigerant circuit configuration of a multi-room air conditioning apparatus according to Embodiment 2 of the present invention. Like that of Embodiment 1, a multi-room air conditioning apparatus according to Embodiment 2 also includes one outdoor unit 9 and a plurality of indoor units 5-1 to **5-*n*, in which the plurality of indoor units 5-1 to 5-*n* are connected in parallel to the outdoor unit 9 to form a refrigerant circuit. In Embodiment 2, the outdoor unit 9 is provided therein with a compressor 1, a four-way valve 2 switching a direction in which a refrigerant flows, and an outdoor heat exchanger 3, and a blower fan 8. The indoor units 5-1 to 5-*n* have electronic expansion valves 4-1 to 4-*n* provided therein, respectively, for decompressing a condensed refrigerant. The compressor 1 and the four-way valve 2 are controlled by a control device (outdoor unit control device) 6. The electronic expansion valves 4-1 to 4-*n* are controlled by control devices (indoor unit control device) 10-1 to 10-*n* provided in the indoor units, respectively. The control device 6 is capable of receiving various pieces of indoor unit operation information such as an operation command issued by the indoor units 5-1 to 5-*n***.

Like that of Embodiment 1, the outdoor unit 9 is provided on the upper portion of the compressor shell or on the discharge tubes or the like with a discharge temperature sensor 7 for sensing the temperature of a refrigerant discharged through the compressor. The control device 6 can receive temperature information provided by the discharge temperature sensor 7.

Embodiment 3

Figure 3:
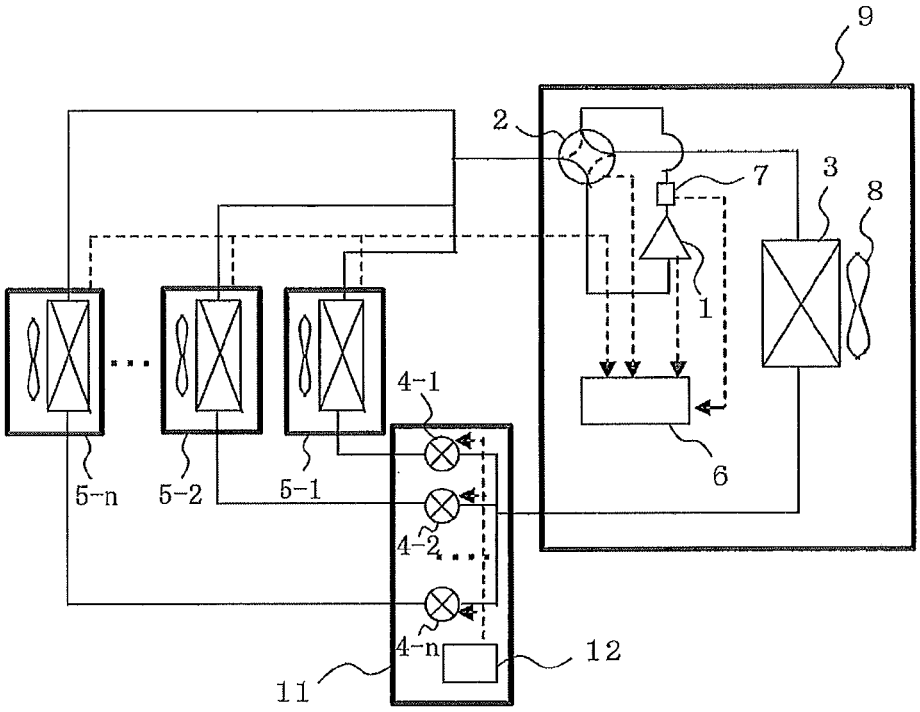
FIG. 3 is a refrigerant circuit configuration of a multi-room air conditioning apparatus according to Embodiment 3 of the present invention.

FIG. 3 is a refrigerant circuit configuration of a multi-room air conditioning apparatus according to Embodiment 3 of the present invention. Like those of Embodiments 1 and 2, a multi-room air conditioning apparatus according to Embodiment 3 also includes one outdoor unit 9 and a plurality of indoor units 5-1 to **5-*n*, wherein the plurality of indoor units 5-1 to 5-*n* are connected in parallel to the outdoor unit 9 to form a refrigerant circuit. In Embodiment 3, the outdoor unit 9 is provided therein with a compressor 1, a four-way valve 2 switching a direction in which a refrigerant flows, and an outdoor heat exchanger 3, and a blower fan 8. The electronic expansion valves 4-1 to 4-*n* corresponding to the indoor units 5-1 to 5-*n*, respectively, are provided in a branch box 11. The compressor 1 and the four-way valve 2 are controlled by a control device 6. The electronic expansion valves 4-1 to 4-*n* are controlled by a control device (branch box control device) 12 provided inside the branch box 11. The control device (outdoor unit control device) 6 is capable of receiving various pieces of indoor unit operation information such as an operation command issued by the indoor units 5-1 to 5-*n***.

Like those of Embodiments 1 and 2, the outdoor unit 9 is provided on the upper portion of the compressor shell or on the discharge tubes or the like with a discharge temperature sensor 7 for sensing the temperature of a refrigerant discharged through the compressor. The control device 6 can receive temperature information provided by the discharge temperature sensor 7.

Embodiment 4

Figure 4:
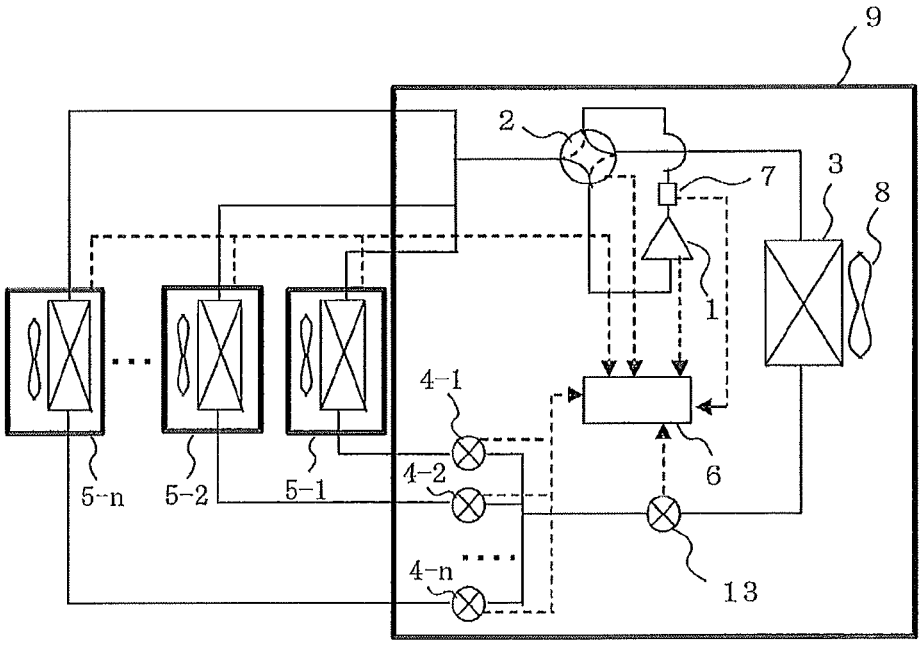
FIG. 4 is a refrigerant circuit configuration of a multi-room air conditioning apparatus according to Embodiment 4 of the present invention.

FIG. 4 is a refrigerant circuit configuration of a multi-room air conditioning apparatus according to Embodiment 4 of the present invention. Like those of Embodiments 1 to 3, a multi-room air conditioning apparatus according to Embodiment 4 also includes one outdoor unit 9 and a plurality of indoor units 5-1 to **5-*n*, in which the plurality of indoor units 5-1 to 5-*n* are connected in parallel by refrigerant piping to the outdoor unit 9 to form a refrigerant circuit. In Embodiment 4, the outdoor unit 9 is provided therein with a compressor 1, a four-way valve 2 for switching the direction in which a refrigerant flows, an outdoor heat exchanger 3, a blower fan 8, and electronic expansion valves 4-1 to 4-*n* that decompress a condensed refrigerant which are arranged so as to correspond to the indoor units 5-1 to 5-*n*, respectively. In order to achieve a higher decompression effect as compared with that of Embodiment 1, an electronic expansion valve 13 is provided in addition to the electronic expansion valves 4-1 to 4-*n*. The compressor 1, the four-way valve 2, and the electronic expansion valves 4-1 to 4-*n*, 13 are controlled by a control device (outdoor unit control device) 6. The control device 6 is capable of receiving various pieces of indoor unit operation information such as an operation command issued by the indoor units 5-1 to 5-*n***.

Like those of Embodiments 1 to 3, the outdoor unit 9 is provided on the upper portion of the compressor shell or on the discharge tubes or the like with a discharge temperature sensor 7 for sensing the temperature of a refrigerant discharged through the compressor. The control device 6 can receive temperature information provided by the discharge temperature sensor 7.

An electronic expansion valve opening degree initialization procedure for the multi-room air conditioning apparatus shown in FIGS. 1 to 3 is described below on the basis of a flowchart of FIG. 5. The multi-room air conditioning apparatus shown in FIGS. 1 to 3 initiates processing steps in FIG. 5 if it receives an operation command from any of the indoor units 5-1 to **5-*n* when an electronic expansion valve opening degree initialization (hereinafter referred to as just "initialization") has not been completed. First, a determination is made as to whether there is an indoor unit which has issued an operation command (S1). If there is an indoor unit which has issued an operation command, initialization is performed on an electronic expansion valve corresponding to that indoor unit (S2). When the initialization has been performed on the electronic expansion valves corresponding to all of the indoor units which have issued an operation command (S3), the flow proceeds to compressor operation processing (S4). A determination is made as to whether there is an electronic expansion valve which has been initialized (S5). If there is an electronic expansion valve which has been initialized, the flow is caused to proceed to a step for adjusting that electronic expansion valve to a predetermined operational opening degree (S6). After the completion of this step (S7), a determination is made as to whether there is an electronic expansion valve which has no operation command from its corresponding indoor unit and has not yet been initialized (S8). If there is an electronic expansion valve which has not yet been initialized, initialization (S9) for that electronic expansion valve and a step for causing the flow to proceed to the opening degree adjustment are performed (S10) to (S11**).

Figure 5:
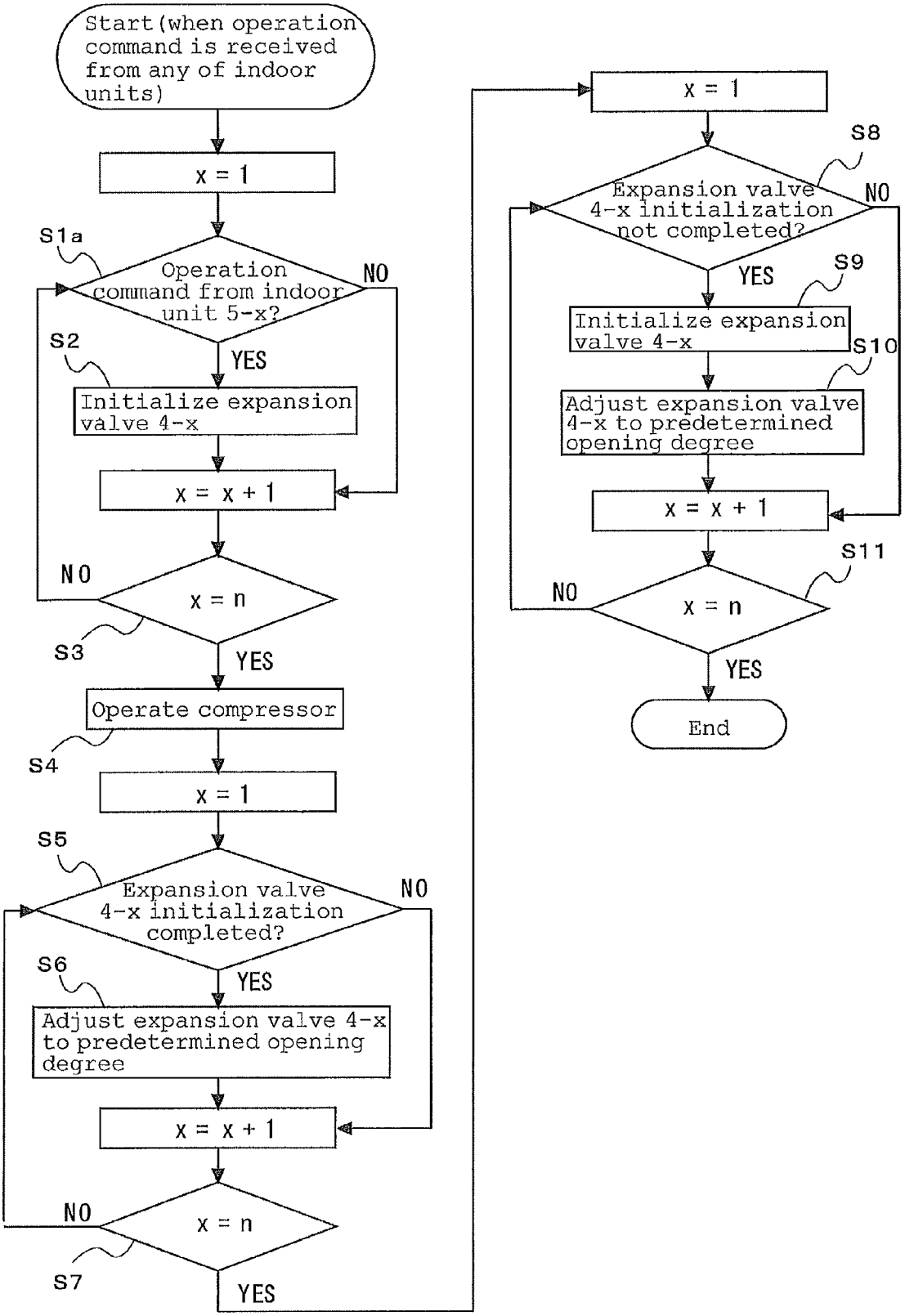
FIG. 5 is a flowchart illustrating an example of an electronic expansion valve opening degree initialization procedure for a multi-room air conditioning apparatus according to the present invention.
Figure 6:
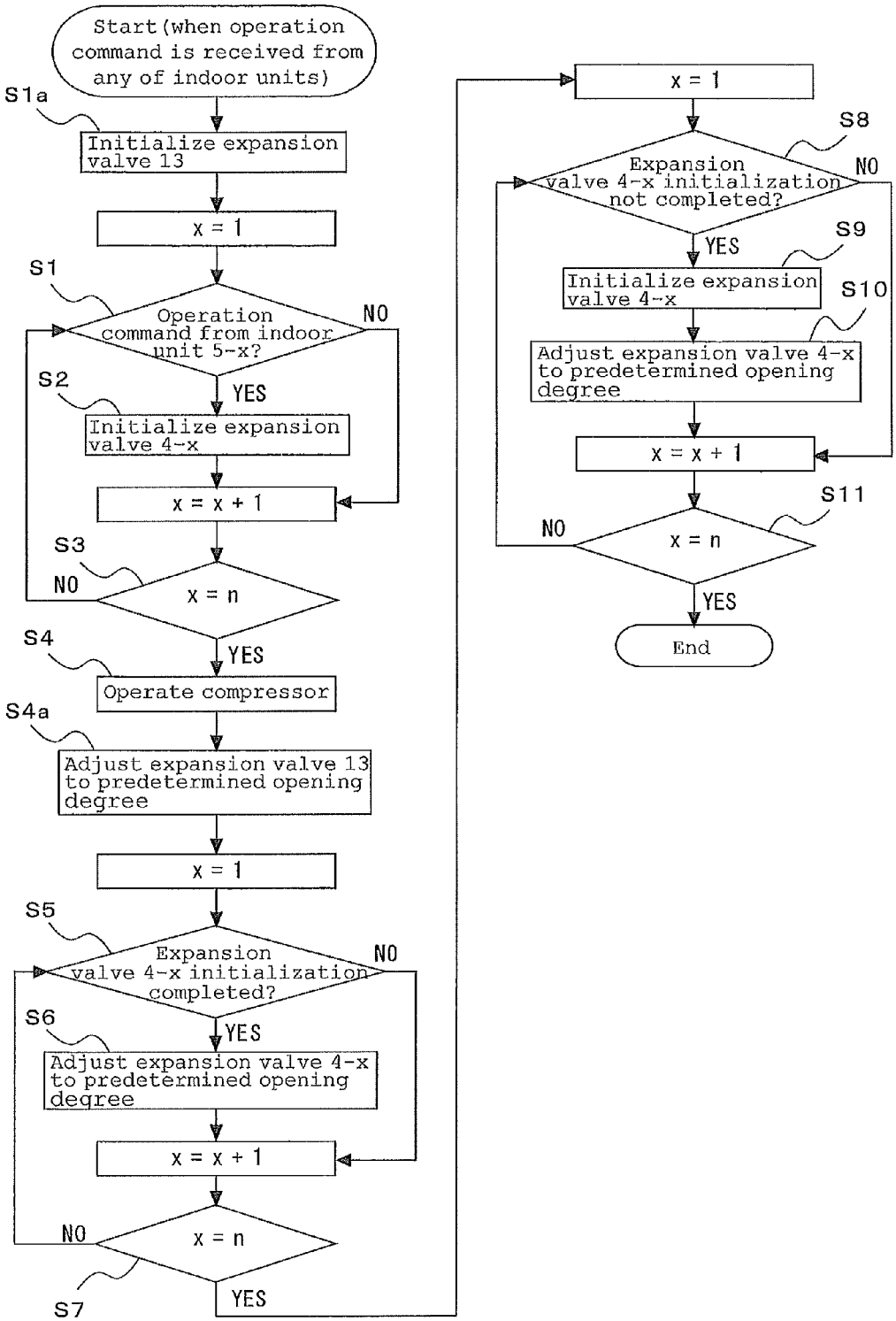
FIG. 6 is a flowchart illustrating another example of an electronic expansion valve opening degree initialization procedure for a multi-room air conditioning apparatus according to the present invention.

In the case of a multi-room air conditioning apparatus provided with an electronic expansion valve 13 having no corresponding indoor unit (see FIG. 4), an electronic expansion valve initialization is performed according to the flowchart of FIG. 6. In other words, the initialization for such an electronic expansion valve 13 is performed before the activation of the compressor (S1*a*). The initialization for the electronic expansion valve 13 may be performed after the initialization for the electronic expansion valves 4-1 to 4-*n* having their corresponding indoor units has been completed, if it is done before the activation of the compressor. Also, the flow is caused to proceed to the opening degree adjustment of the electronic expansion valve 13 before the flow is caused to proceed to the opening degree adjustment of the electronic expansion valves 4-1 to 4-*n* whose initialization has been completed following the activation of the compressor (S5*a*). Subsequently, the electronic expansion valve initialization, activation of the compressor, and opening degree adjustment may be performed according to the same procedure as that of FIG. 5.

If there are not many indoor units that have issued an operation command, Embodiments 1 to 4 allow the compressor to be activated sooner as compared to the case where the compressor is activated after the completion of electronic expansion valve initialization. This allows speedier start-up of cooling/heating capabilities, giving no inconvenience to users.

In a multi-room air conditioning apparatus configured as in FIGS. 1 to 3, a refrigerant discharged from the compressor may experience an abrupt temperature rise if an attempt is made to initialize the electronic expansion valve corresponding to an indoor unit that has issued no operation command after the compressor is activated as shown in the flowchart of FIG. 5. If this occurs, a refrigerant present in a liquid state in the compressor abruptly vaporizes, which causes a compressor lubricating oil dissolved in such a liquid refrigerant to be taken out of the compressor, resulting in a damaged or a failed compressor due to defective lubrication.

Figure 7:
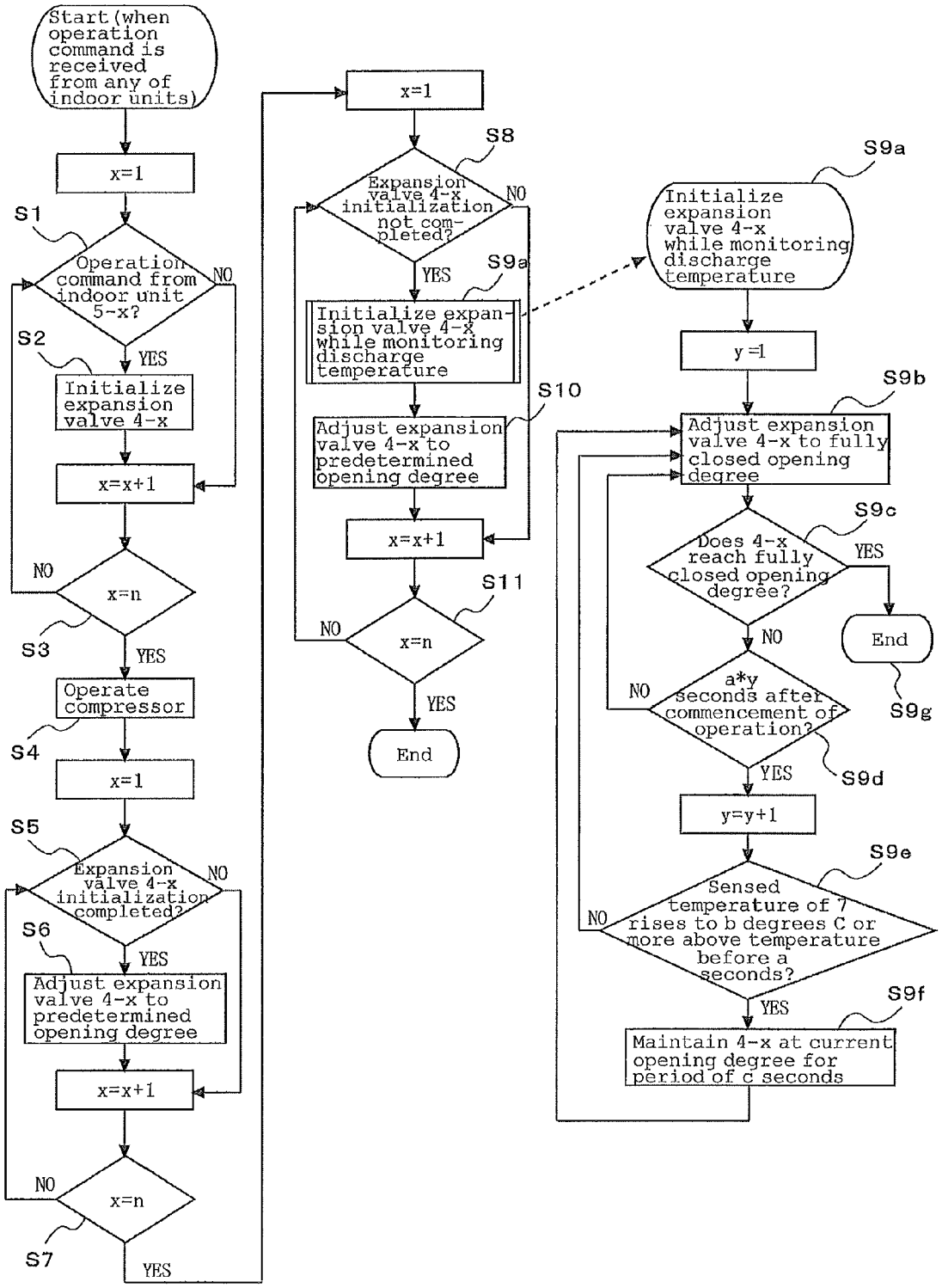
FIG. 7 is a flowchart illustrating further another example of an electronic expansion valve opening degree initialization procedure for a multi-room air conditioning apparatus according to the present invention.
Figure 8:
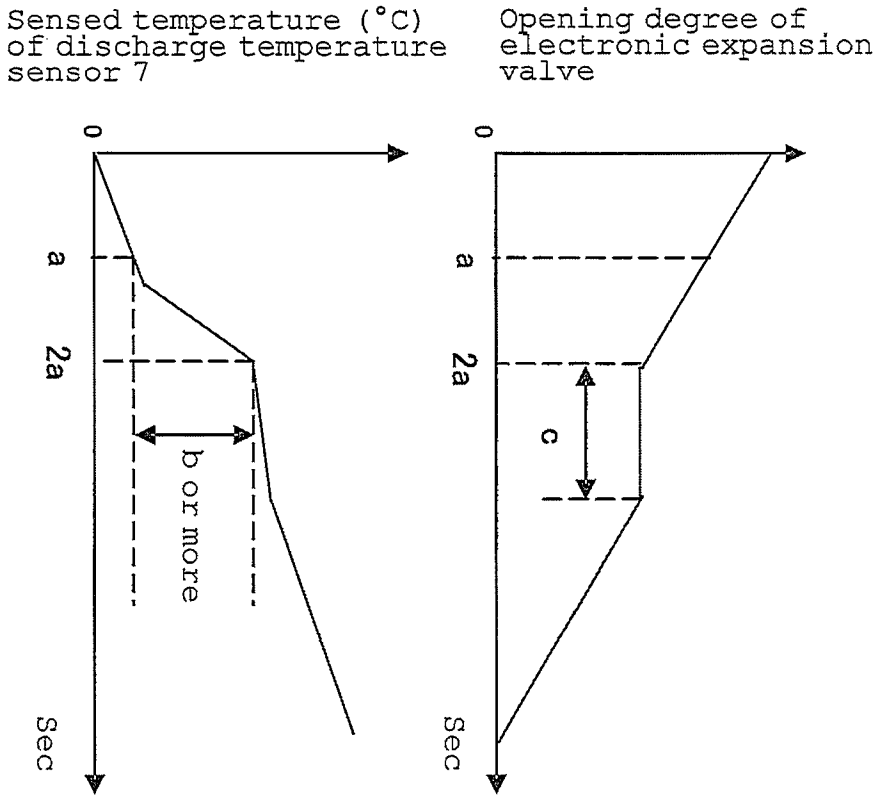
FIG. 8 is a diagram showing the relationship between a sensed temperature of a discharge temperature sensor and an opening degree of the electronic expansion valve.

In order to solve this problem, an electronic expansion valve initialization procedure for preventing an ejection of a lubricating oil from the compressor due to the abrupt temperature rise of the refrigerant in the compressor and thereby avoiding a risk of damage to the compressor is described below on the basis of FIG. 7 showing a flowchart and FIG. 8 showing the relationship between a sensed temperature of a discharge temperature sensor 7 and an electronic expansion valve opening degree.

In the flowchart of FIG. 7, steps S1 to S8 are the same as those of FIG. 5. In step S8, a determination is made as to whether there is an electronic expansion valve that has received no operation command from its corresponding indoor unit and whose initialization has not yet been completed even after the activation of the compressor. If there is such an electronic expansion valve whose initialization has not yet been completed, it will be initialized while the refrigerant discharge temperature of the compressor is monitored using the discharge temperature sensor 7 (S9*a*). In other words, as shown in FIGS. 7 and 8, a difference between a current sensed temperature value measured every "a"-second by the discharge temperature sensor 7 and a sensed temperature value measured before "a"-second is determined. If the difference is found to be equal to or greater than "b" degrees C., the initialization step is suspended and a current opening degree is maintained for a period of "c"-second (S9*b* to S90. Thereafter, when all of the un-initialized electronic expansion valves have been initialized (S9*g*), the flow is caused to proceed to opening degree adjustment for those electronic expansion valves (S10).

Please note that FIG. 8 shows the relationship between an electronic expansion valve closing operation and changes in discharge temperature when the above processing steps take place, indicating that the difference becomes greater than "b" degrees C. at twice of "a"-second.

As shown in FIG. 4, processing steps of FIG. 7 can also be applied to a multi-room air conditioning apparatus provided with an electronic expansion valve 13 having no corresponding indoor unit. In processing steps of FIG. 6, the same steps as those of FIG. 7 are performed when an attempt is made to initialize an electronic expansion valve that has received no operation command from its corresponding indoor unit and whose initialization has not yet been completed even after the activation of the compressor.

As described above, in Embodiments 1 to 4, if, after the compressor is activated, an attempt is made to initialize an electronic expansion valve corresponding to an indoor unit which has issued no operation command, application of processing steps of FIG. 7 can avoid damage to the compressor arising from an ejection of a compressor lubricating oil associated with a rapid temperature rise of the compressor lubricating oil, while, if there are too many indoor units which receive an operation command, the compressor can be activated sooner as compared to the case where the compressor is activated after all of the electronic expansion valve are initialized. This allows speedier start-up of cooling/heating capabilities, giving no inconvenience to users.

REFERENCE NUMERALS

1: compressor, 2: four-way valve, 3: outdoor heat exchanger, 4-1: 4-2: 4-*n*: electronic expansion valve, 5-1: 5-2: 5-*n*: indoor unit, 6: outdoor unit control device, 7: discharge temperature sensor, 8: blower fan, 9: outdoor unit, 10-1: 10-2: 10-*n*: indoor unit control device, 11: branch box, 12: branch box control device, 13: electronic expansion valve

The invention claimed is:

1. A multi-room air conditioning apparatus comprising:

a plurality of indoor units;

a compressor;

an outdoor heat exchanger;

a four-way valve;

a plurality of electronic expansion valves corresponding to said plurality of indoor units, respectively; and a control device for controlling said compressor, said outdoor heat exchanger, said four-way valve, said plurality of indoor units, and said plurality of electronic expansion valves, wherein said control device is configured to perform the following processing steps of initializing all said electronic expansion valves by fully closing the opening degree of the electronic expansion valves to adjust the starting point when an operation command is issued to part of said indoor units of said plurality of indoor units, all of said plurality of indoor units being in a shutdown state, in a case where an opening degree of all said electronic expansion valves have not yet been initialized:

(a) each opening degree of only electronic expansion valves corresponding to only those indoor units which have issued an operation command is initialized to be fully closed;

(b) after the initialization is completed for said electronic expansion valves corresponding to only those indoor units which have issued an operation command, said compressor is activated;

(c) after the compressor is activated, the opening degree of said electronic expansion valves whose initialization has been completed is adjusted for a first time, to a predetermined operational opening degree; and (d) in a state in which said compressor is activated, each opening degree of said electronic expansion valves corresponding to said indoor units which have issued no operation command is initialized, for a first time, to be fully closed and then is adjusted, for a first time, to a predetermined opening degree.

2. The multi-room air conditioning apparatus of claim 1, further comprising:

a sensor sensing a compressor discharge temperature, wherein, if the compressor discharge temperature sensed by said sensor abnormally rises while the opening degree of said electronic expansion valves corresponding to said indoor units which have issued no operation command is being initialized, said control device is configured to suspend closing of said electronic expansion valves for a certain period of time and to maintain the current opening degree for a certain period of time.

3. A method for controlling a multi-room air conditioning apparatus including a plurality of indoor units, a compressor, an outdoor heat exchanger, a four-way valve, a plurality of electronic expansion valves corresponding to said plurality of indoor units, respectively and a control device for controlling said compressor, said outdoor heat exchanger, said four-way valve, said plurality of indoor units, and said plurality of electronic expansion valves, the method comprising:

said control device performing the following processing steps of initializing all said electronic expansion valves by fully closing the opening degree of the electronic expansion valves to adjust the starting point when an operation command is issued to part of said indoor units of said plurality of indoor units, all of said plurality of indoor units being in a shutdown state, in a case where an opening degree of all said electronic expansion valves have not yet been initialized:

(a) initializing, to be fully closed, each opening degree of electronic expansion valves corresponding to only those indoor units which have issued an operation command;

(b) activating said compressor after the initialization is completed for said electronic expansion valves corresponding to only those indoor units which have issued an operation command;

(c) adjusting, for the first time, the opening degree of said electronic expansion valves whose initialization has been completed to a predetermined operational opening degree after the compressor is activated; and (d) in a state in which said compressor is activated, initializing, for the first time, each opening degree of said electronic expansion valves corresponding to said indoor units which have issued no operation command to be fully closed and then adjusting, for the first time, to a predetermined opening degree.

* * * * *